US006903712B1

(12) United States Patent
Yamashita

(10) Patent No.: US 6,903,712 B1
(45) **Date of Patent: *Jun. 7, 2005**

(54) DISPLAY DEVICE AND DRIVING METHOD THEREOF

(75) Inventor: Akihiro Yamashita, Saga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/550,962

(22) Filed: Apr. 17, 2000

(30) Foreign Application Priority Data

Apr. 16, 1999 (JP) ..... 11-109370

(51) Int. Cl.[7] ..... G09G 3/30

(52) U.S. Cl. ..... 345/76; 345/74.1; 345/77; 315/169.3; 315/169.4

(58) Field of Search ..... 345/45, 46, 48, 345/66, 77, 74.1, 100, 76, 99, 89, 55, 82; 315/169.2, 169.3, 169.4; 347/43; 445/24

(56) References Cited

U.S. PATENT DOCUMENTS

| | | | | | |
|---|---|---|---|---|---|
| 4,595,862 | A | * | 6/1986 | Morimoto et al. | 315/169.4 |
| 5,095,248 | A | * | 3/1992 | Sato | 315/169.3 |
| 5,378,519 | A | * | 1/1995 | Kikuchi et al. | 428/690 |
| 5,565,742 | A | * | 10/1996 | Shichao et al. | 315/366 |
| 5,600,343 | A | * | 2/1997 | Sarrasin | 345/75.2 |
| 5,854,540 | A | * | 12/1998 | Matsumoto et al. | 315/169.1 |
| 5,859,508 | A | * | 1/1999 | Ge et al. | 315/366 |
| 5,978,403 | A | * | 11/1999 | Iwasa et al. | 372/50 |
| 5,978,404 | A | * | 11/1999 | Ishihara | 372/50 |
| 6,195,075 | B1 | * | 2/2001 | Shino et al. | 345/68 |
| 6,195,142 | B1 | * | 2/2001 | Gyotoku et al. | 349/69 |
| 6,201,520 | B1 | | 3/2001 | Iketsu et al. | |
| 6,222,323 | B1 | | 4/2001 | Yamashita et al. | |
| 6,369,515 | B1 | | 4/2002 | Okuda | |

FOREIGN PATENT DOCUMENTS

| | | |
|---|---|---|
| JP | 01-255891 | 10/1989 |
| JP | 01-319787 | 12/1989 |
| JP | 06301355 | 10/1994 |
| JP | 09-185344 | 7/1997 |
| JP | 09232074 | 9/1997 |
| JP | 10-187096 | 7/1998 |
| JP | 10-319910 | 12/1998 |
| JP | 11-95723 | 4/1999 |
| JP | 2000-98974 | 4/2000 |

* cited by examiner

*Primary Examiner*—Xiao Wu
*Assistant Examiner*—Abbas Abdulselam
(74) *Attorney, Agent, or Firm*—RatnerPrestia

(57) ABSTRACT

In a display device arranging anode wires and cathode wires in a matrix shape, disposing light emitting elements at the intersections, scanning and driving the cathodes at specific time intervals, and driving the anode of a desired light emitting element in synchronism therewith, thereby selectively emitting the light emitting element, the display controller includes a setting unit for setting the discharge time for discharging the accumulated charge of the light emitting elements before light emitting of the light emitting elements, and operates and controls the anode controller and cathode controller for discharging the accumulated charge of the light emitting elements within the set discharge time, and also operates and controls the anode controller and cathode controller for emitting the light emitting elements after discharge control of the accumulated charge. In the display device having such configuration, supposing the luminance of the light emitting element when emitting light in no-charge or almost no-charge accumulated state to be Le, and the luminance by actual light emission to be Lp, they are in the relation of $Lp \geqq 0.9 \times Le$, and further supposing the discharge time to satisfy this relation to be Tx, the discharge time Rt of actual discharge is determined to satisfy the relation of $Tx \leqq Rt$.

25 Claims, 16 Drawing Sheets

DISPLAY DEVICE AND DRIVING METHOD THEREOF

FIELD OF THE INVENTION

The present invention relates to a driving circuit of a display device for displaying information by light emission of a plurality of light emitting elements, and more particularly to a display device used in a portable terminal or the like and a driving method thereof.

BACKGROUND OF THE INVENTION

It has been recently attempted intensively to apply organic electroluminescence (EL) elements in a display panel by matrix configuration. A simple matrix method is known as a driving method of this organic EL display panel.

In this system, anodes and cathodes are arranged in a matrix shape, and light emitting elements are disposed at intersections of anodes and cathodes. According to this method, the cathodes are scanned and driven at specific time intervals, and an anode of a desired light emitting element is driven in synchronism therewith, so that the specific light emitting element is selected to emit light.

FIG. 11 is an equivalent circuit diagram showing this simple matrix driving system.

As shown in FIG. 11, anode wires (A1, A2, . . . , Am) and cathode wires (C1, C2, . . . , Cn) are arranged in a matrix shape. Light emitting elements are disposed at intersections of the anode wires and cathode wires.

An example of operation for selecting and lighting $L_{1,1}$, $L_{2,1}$, of multiple organic EL elements $L_{1,1}$, to $L_{m,n}$ shown in FIG. 11 is described below.

Anode wires A1, A2 are connected to current sources J1, J2 through switches SA1, SA2, respectively. Cathode wire C1 is connected to the ground potential through a switch SC1. By these connections, $L_{1,1}$, $L_{2,1}$ are selectively provided with a forward bias voltage, and emit light. At this time, switches SA3 to SAm connect anode wires A3 to An corresponding to these switches to the ground potential, and switches SC2 to SCn connect cathode wires C2 to Cn corresponding to these switches to the Vcc potential. The switches SA3 to SAm and switches SC2 to SCn operate to prevent error of lighting non-selected elements.

Conventionally, when driving the display panel of such simple matrix system, it is a known problem that the anode voltage of the element to emit light is not raised promptly due to capacitive component of the organic EL element. To solve this problem, a driving method disclosed in Japanese Laid-open Patent No. 9-232074 is known. In this driving method, every time the cathode wire is driven, all cathodes are connected to the reset voltage at the same potential, so that the element accumulated charge is instantly discharged to zero.

However, this conventional driving method had the following problems. FIG. 12 is a diagram showing a discharge current waveform in the case of discharge of accumulated charge of a display panel in a configuration of 256×64 dots. By simple matrix driving, all elements are driven in non-luminescent state. An inverse bias charge is accumulated in organic EL elements on the cathode wires except for driven cathode wires. Consequently, by connecting the anode wires A1 to A256 and cathodes C1 to C64 to the ground potential, the accumulated charge in the organic EL elements is discharged. FIG. 12 shows the discharge current waveform at this time. In FIG. 12, the wires are connected to the ground potential at the timing of T1. By this connection, discharge is started. On the actual display panel, there are wiring impedance and output impedance of switching means. Therefore, as shown in FIG. 12, the discharge current of the element accumulated charge shows a gradual approach to zero with the passing of the time. A sufficient discharge time was needed until the element accumulated charge would decrease to a practically safe level. However, such discharge time of accumulated charge was not taken into consideration in the conventional driving method.

Besides, as a result of studies by the present inventor, it was found out that another problem is caused by parasitic capacity of organic EL element. For example, it occurs in the driving circuit shown in the driving method disclosed in Japanese Laid-open Patent No. 6-301355. FIG. 13 is an example of a driving circuit presented in an embodiment of the invention disclosed in Japanese Laid-open Patent No. 6-301355. As shown in FIG. 13, this driving circuit is mainly composed of organic EL elements indicated by diode symbols, anode wires $Y_1$ to $Y_m$, and cathode wires $X_1$ to $X_n$.

In this driving circuit, suppose the following case:

As a first action, all elements on the cathode wire $X_1$ are driven in non-luminescent state;

As a second action, cathode wire scanning and driving is advanced by one line, and all elements on $X_2$ emit light.

In the first action, all bipolar transistors $\mathbf{10}_1$ to $\mathbf{10}_m$ are turned off, and the anode wires $Y_1$ to $Y_m$ are at the ground potential. A field effect transistor 71 of a row selection changer 8 is turned on, and the cathode wire $X_1$ is connected to the ground potential. Other cathode wires $X_2$ to $X_n$ are turned off except for the field effect transistor 71 of the row selection changer 8, and are pulled up to a forward bias driving voltage VB. Therefore, the organic EL elements on cathode wires $X_2$ to $X_n$ are inversely biased, and an electric charge is accumulated.

In the second action, field effect transistors $\mathbf{11}_1$ to $\mathbf{11}_m$ are turned off, bipolar transistors $\mathbf{10}_1$ to $\mathbf{10}_m$ are turned on, and a driving voltage VB is applied to anode wires $Y_1$ to $Y_m$. A field effect transistor 72 is turned on, and cathode wire $X_2$ is connected to the 20 ground potential. Other cathode wires $X_1$, $X_3$ to $X_n$ are turned off except for the field effect transistor 72, and are pulled up to a forward bias driving voltage VB.

Paying attention to cathode wires $X_3$ to $X_n$ in this second action, an electric charge is accumulated in the elements on cathode wires, and a driving voltage VB is generated at both ends of the element. Accordingly, the sum potential 2 VB of the driving voltage VB applied to the anode wires $Y_1$ to $Y_m$ and the voltage VB produced by accumulated charge is instantly applied to both ends of the element. Later, the accumulated charge is discharged through a pull-up resistance Rc. Along with this discharge the voltage at both ends of the element gradually approaches the voltage VB. Thus, by the accumulated charge, a maximum voltage of 2 VB is generated at both ends of the element. This maximum voltage 2 VB is also applied to the field effect transistors for driving the cathodes. In these field effect transistors and other semiconductor switching elements, the maximum value of applicable voltage is determined as the absolute maximum rating, individually. If a larger voltage is applied, the reliability of the semiconductor switching element is lowered significantly. It is hence necessary to select a semiconductor switching element having a sufficient withstand voltage for actual voltage. Generally, to heighten the withstand voltage of the semiconductor switching element, it is considered in the semiconductor process, or in the design of the semiconductor, or in both. The higher the withstand voltage, the higher is the cost of the semiconductor switching element, and the scale of integration of elements is lower. Therefore, the conventional device was a serious problem for lowering the cost and reducing the size and weight.

Thus, in the conventional driving method, no particular consideration is given to the discharge time of the element accumulated charge. Accordingly, the anode voltage of the element to emit light is not always raised to high voltage promptly. Besides, an excessively long discharge time is effective as measure against the problem by the element accumulated charge. However, if the discharge time is excessively long, since light is not emitted in the discharge time, the driving efficiency is worsened. By poor driving efficiency, it appears that the display luminance is lowered.

SUMMARY OF THE INVENTION

It is an object of the invention to prevent occurrence of the above problems by presenting a driving method optimized in discharge of element accumulated charge in a display device using organic EL elements.

The invention provides a display device comprising:

a. a plurality of cathode wires, b. a plurality of anode wires arranged in a matrix shape together with the plurality of cathode wires, c. light emitting elements disposed at specified intersections of the plurality of cathode wires and anode wires, d. a current source to the anode wires, e. a voltage source to the cathode wires, f. an anode control circuit for connecting between the anode wires and current source, g. a cathode control circuit for connecting between the cathode wires and voltage source, and h. a display controller for controlling light emission of the light emitting elements.

The display controller includes a setting unit for setting the discharge time for discharging the accumulated charge of the light emitting elements before light emission of the light emitting elements. The display controller operates and controls the anode control circuit and cathode control circuit for discharging the accumulated charge of the light emitting elements within the set discharge time, and also operates and controls the anode control circuit and cathode control circuit for emitting the light emitting elements after discharge control of the accumulated charge.

In the display device having such configuration, supposing the luminance of the light emitting element when emitting light in no-charge or almost no-charge accumulated state to be Le, and the luminance by actual light emission to be Lp, they are in the relation of $$Lp \geqq 0.9 \times Le$$

and further supposing the discharge time to satisfy this relation to be Tx, the discharge time Rt of actual discharge is determined to satisfy the relation of $$Tx \leqq Rt.$$

Therefore, by properly setting the discharge time Rt, the electric charge accumulated in the light emitting element can be removed effectively. As a result, the driving efficiency is improved, and it improves the conventional defect of an apparent lowering of display luminance. Moreover, it brings about a beneficial effect of realizing the display device higher in driving speed, superior in reliability, lower in price, and smaller in size.

DETAILED DESCRIPTION OF THE PREFERRED EMBODIMENTS

Figure 1:
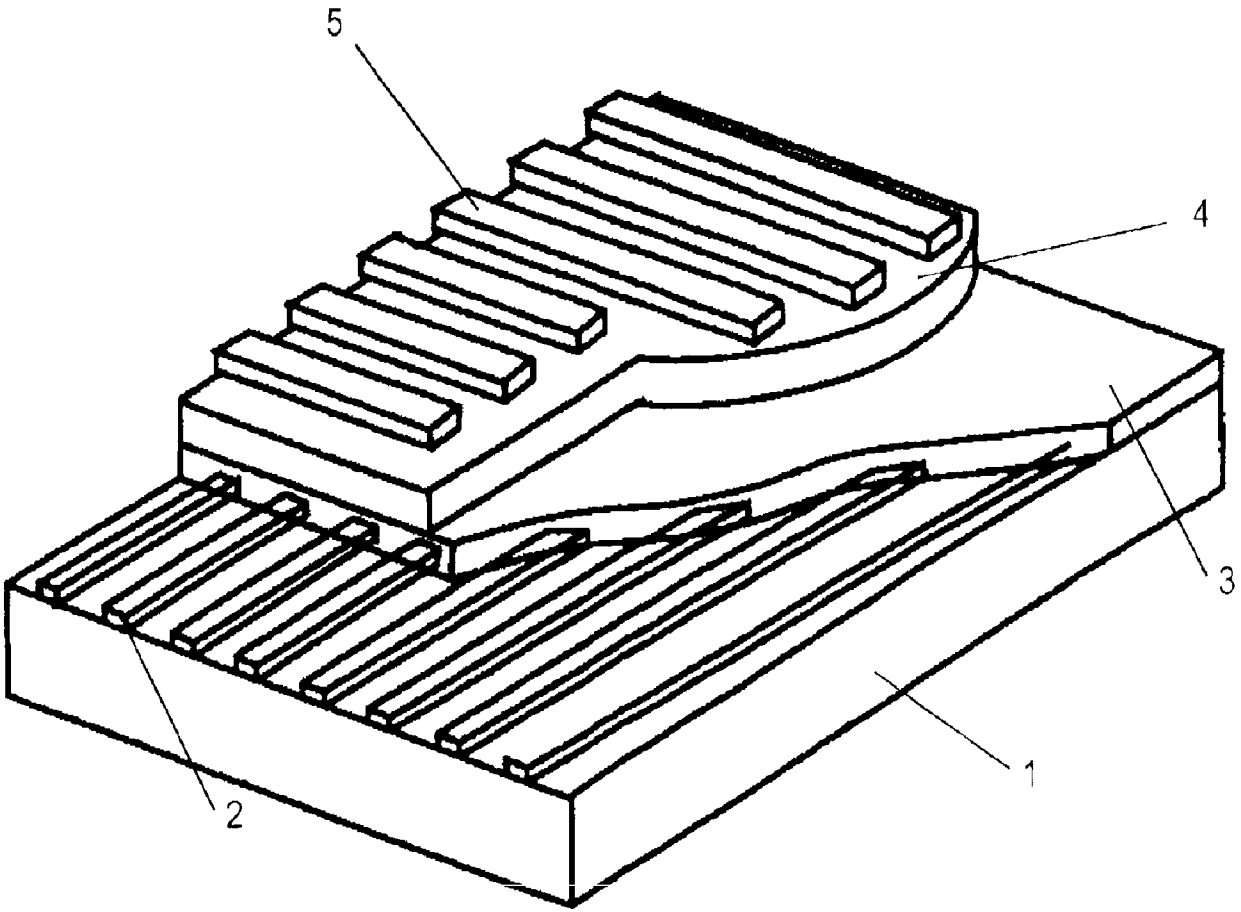
FIG. 1 is a magnified perspective view showing a display device in embodiment 1 of the invention.

Referring now to the drawings, preferred embodiments of the invention are described below.

Embodiment 1

Figure 2:
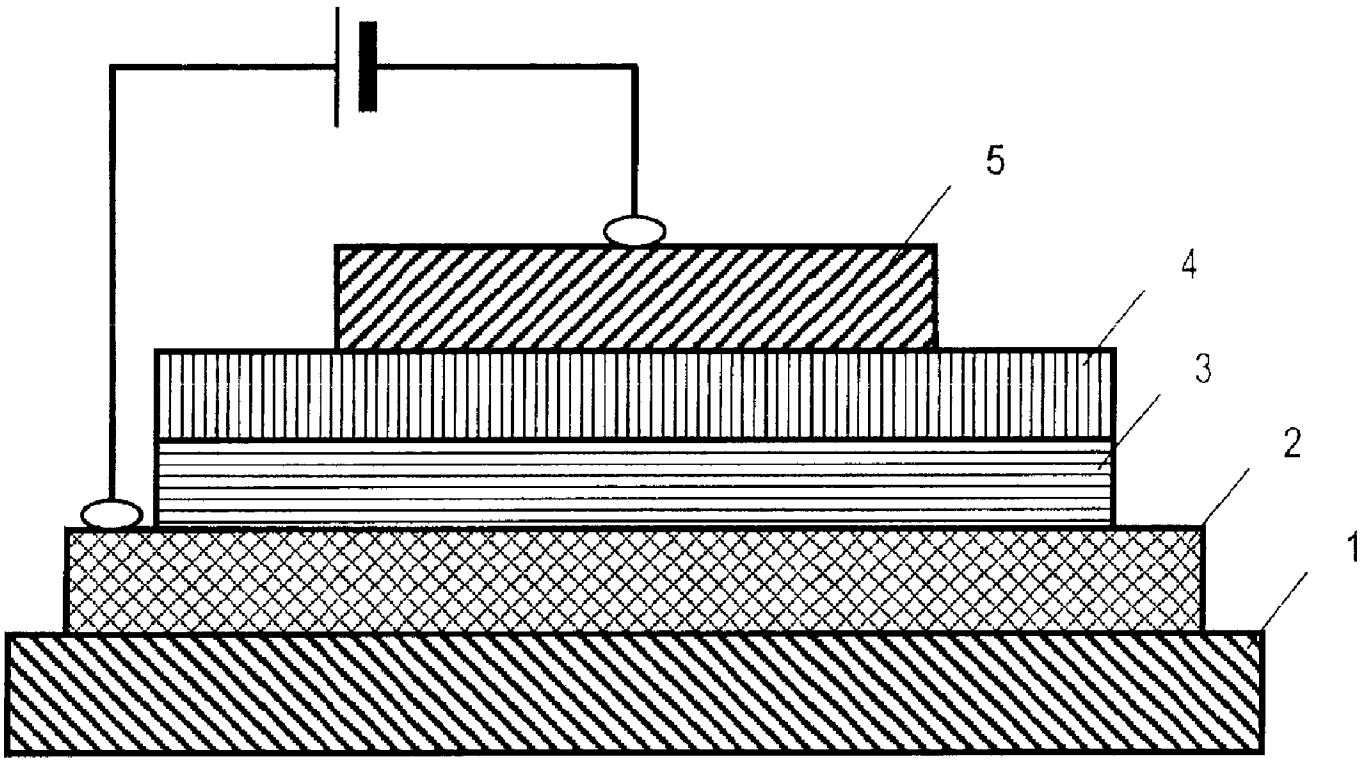
FIG. 2 is a partially magnified sectional view of the display device in embodiment 1 of the invention.

In FIG. 1 and FIG. 2, the display device of embodiment 1 comprises:

a) a substrate 1 made of transparent glass, polymer film or the like, b) a plurality of anode wires 2 formed on the substrate 1, c) a Hall transport layer 3 provided on the substrate 1 or anode wires 2, d) a luminescent layer 4 provided on the Hall transport layer 3, and e) a plurality of cathode wires 5 provided on the luminescent layer 4.

In the display device, the plurality of anode wires 2 are formed in stripes. The Hall transport layer 3 and luminescent layer 4 of the display device are composed of organic materials. The plurality of cathode wires 5 of the display device are formed in a matrix to be nearly orthogonal to the plurality of anode wires 2.

In this configuration, by passing a current between the anode wire 2 and cathode wire 5, the luminescent layer 4 enclosed by the anode wire 2 and cathode wire 5 emits light.

Figure 3:
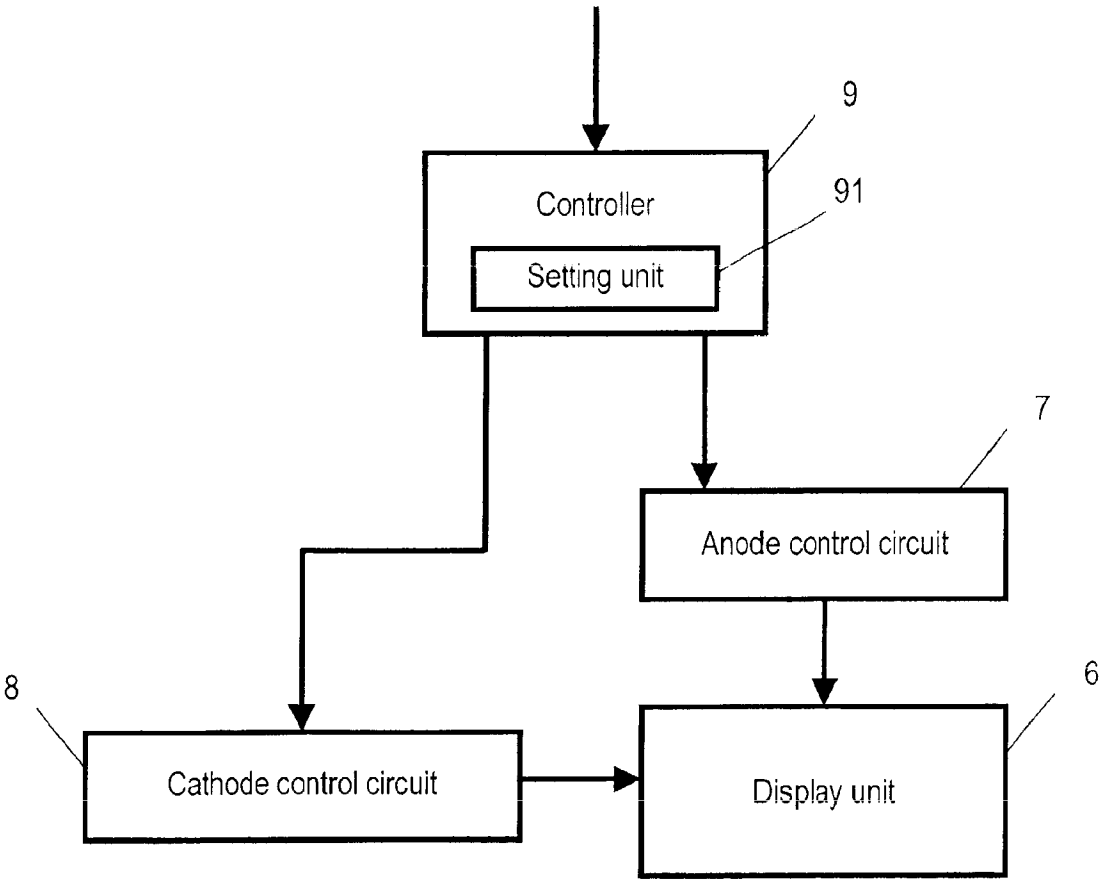
FIG. 3 is a block diagram of the display device in embodiment 1 of the invention.

As shown in FIG. 3, in a display unit 6 composed of organic EL elements shown in FIGS. 1 and 2, a cathode control circuit 8 for controlling the cathode wires 5, and an anode control circuit 7 for controlling the anode wires 2 are connected. The cathode control circuit 8 and anode control circuit 7 are controlled by a display controller 9 such as CPU. The display controller 9 includes a discharge time setting unit 91 which is described below.

The operation of the display device having such configuration is described below.

First, when a signal is sent into the display controller 9 from keyboard (not shown) or other external unit, the display controller 9 judges whether or not to display in the display unit 6 according to the signal. Then, the display controller 9 sends a signal for instruction of display of character or pattern in the display unit 6 to the cathode control circuit 8 and anode control circuit 7. In the anode control circuit 7, one switching element is provided for each anode wire of the display unit 6. Similarly, in the cathode control circuit 8, one switching element is provided for each cathode wire of the display unit 6.

The cathode control circuit 8 sequentially scans the plurality of cathode wires of the cathode wires 5, and the anode control circuit 7 controls so that the current may flow in the anode wire 2 on the luminescent layer 4 to emit light. By the control of the anode control circuit 7 and cathode control circuit 8, specified characters and others are displayed.

The driving method of embodiment 1 is described in detail below while referring to FIG. 4 to FIG. 10.

Figure 4:
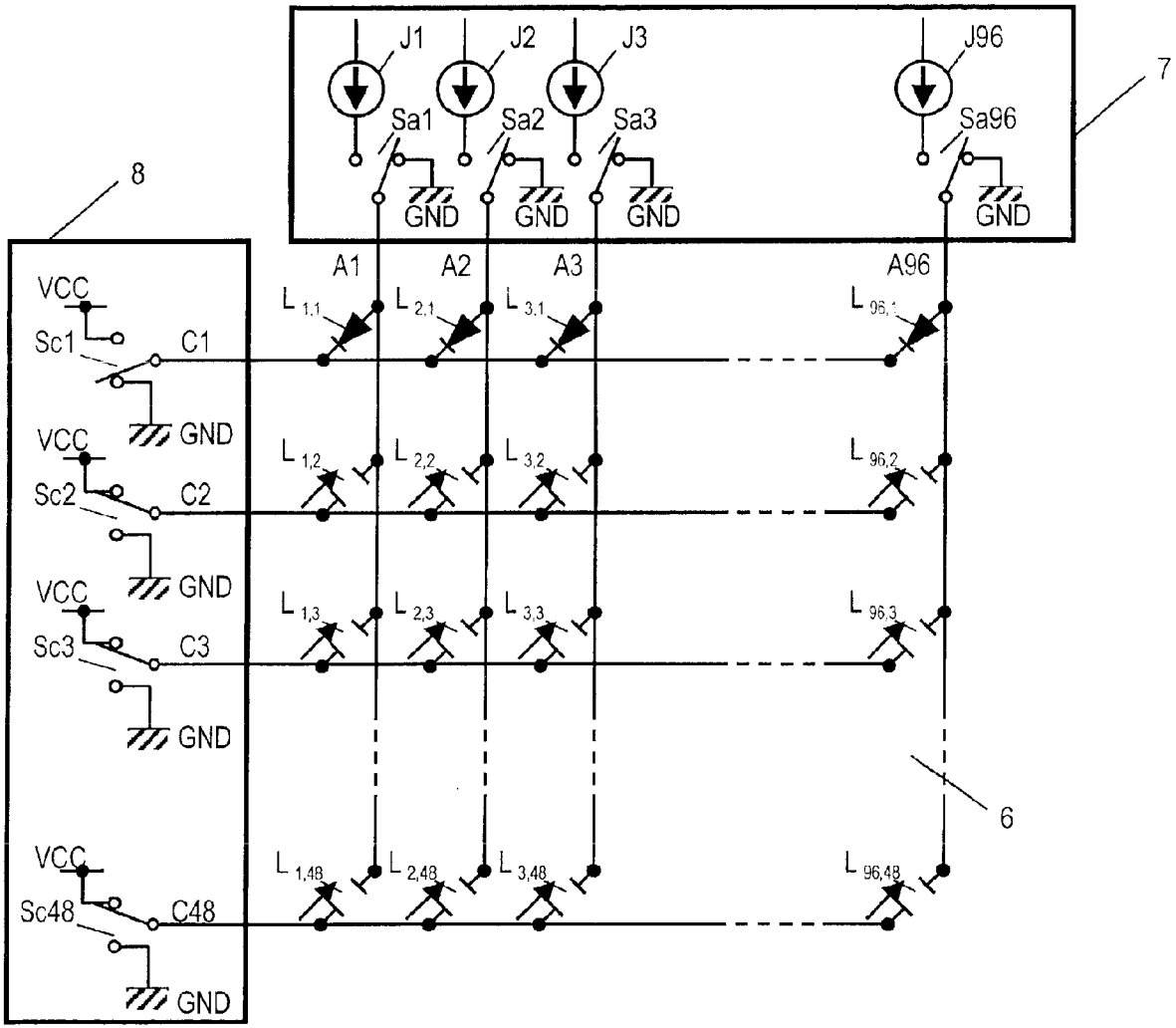
FIG. 4 is a diagram showing a light emitting driving method in embodiment 1 of the invention.

FIG. 4 is a diagram showing all non-luminescent state of organic EL elements on the cathode wire C1 in the display panel composed of 96 dots×48 dots in embodiment 1. In the diagram, the organic EL elements on the cathode wires to be driven are expressed by diode symbols, and other elements are expressed by capacitor symbols.

To keep the above object organic EL elements in nonluminescent state, the anode wires A1 to A96 and cathode wire C1 are connected to the ground potential. The cathode wires C2 to C48 are connected to the supply voltage Vcc. As shown in FIG. 4, the organic EL elements connected to the cathode wires C2 to C48 are in a charge accumulated state by inverse bias.

Figure 5:
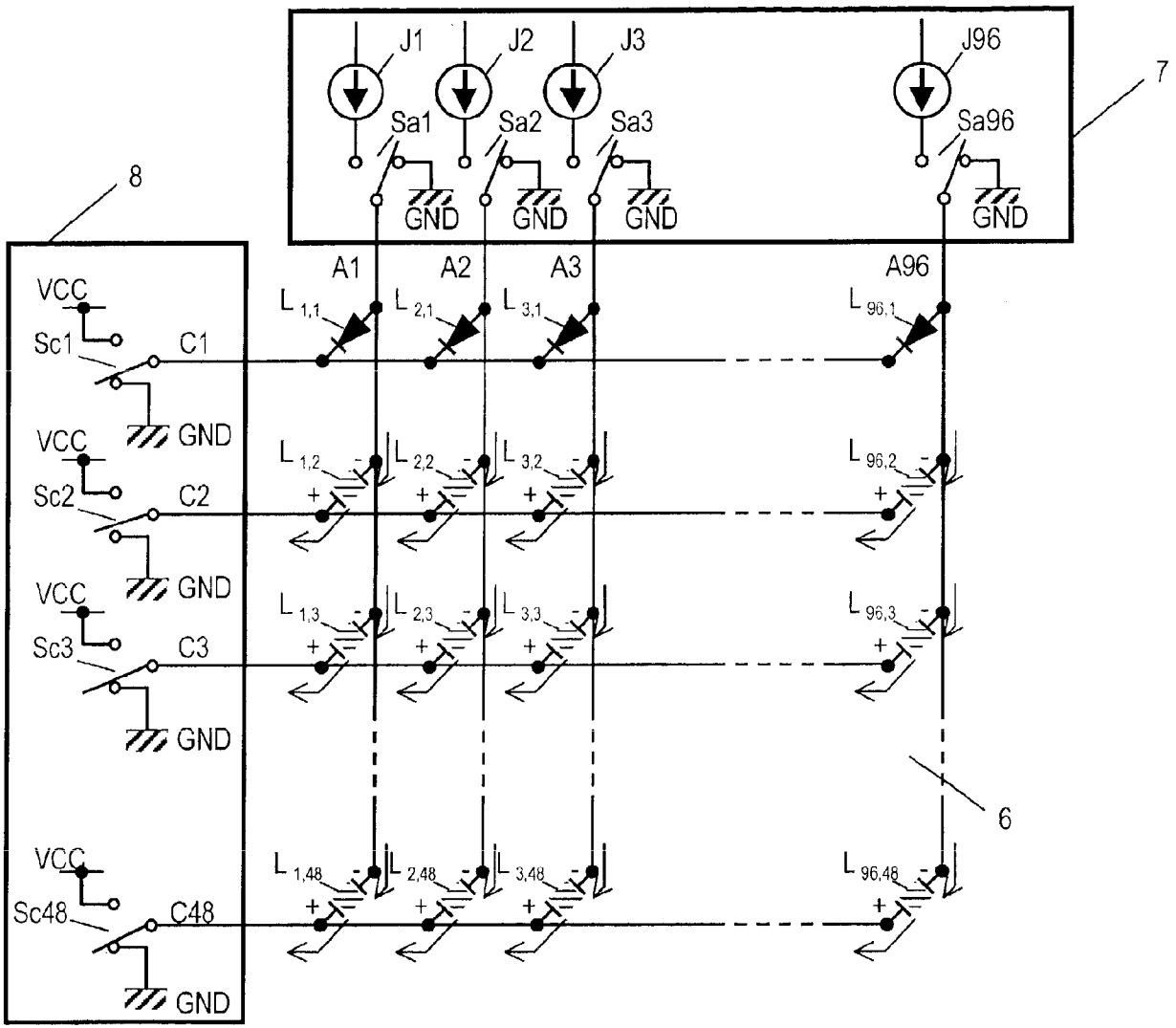
FIG. 5 is a diagram showing a discharge driving method in embodiment 1 of the invention.
Figure 6:
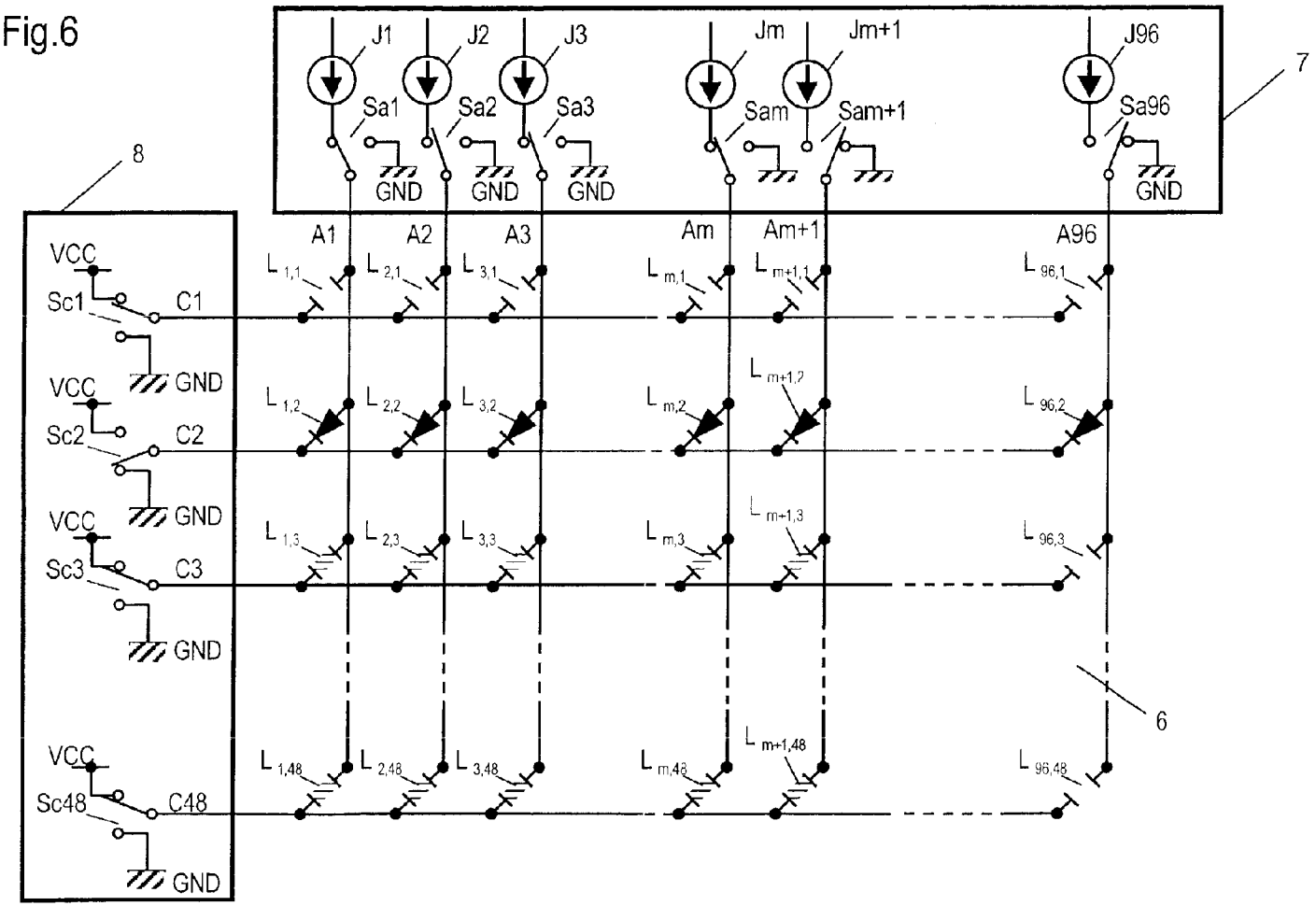
FIG. 6 is a diagram showing a light emitting driving driving method in embodiment 1 of the invention.

Before driving the cathode wire C2 in FIG. 6, discharge operation shown in FIG. 5 is performed for a specified discharge time (Rt). The setting unit 91 provided in the display controller 9 shown in FIG. 3 sets this discharge time. Discharge of accumulated charge is performed for the time set in the setting unit 91. This discharge is effected by connecting both anode wires A1 to A96 and cathode wires C1 to C48 to the ground potential GND. By connecting to the GND, the accumulated charge in the organic EL elements $L_{1,2}$ to $L_{96,2}$, $L_{1,3}$ to $L_{96,3}$, . . . , $L_{1,48}$ to $L_{96,48}$ is discharged through the GND connected to each cathode wire and the GND connected to each anode wire.

After the discharge, next, as shown in FIG. 6, anode wires A1 to Am are connected to current sources J1 to Jm, cathode wire C2 is connected to ground potential, and cathode wires C1, C3 to C48 are connected to supply potential Vcc.

By this connection, the organic EL elements $L_{1,2}$ to $L_{m,2}$ on the cathode wire C2 emit light.

Figure 7:
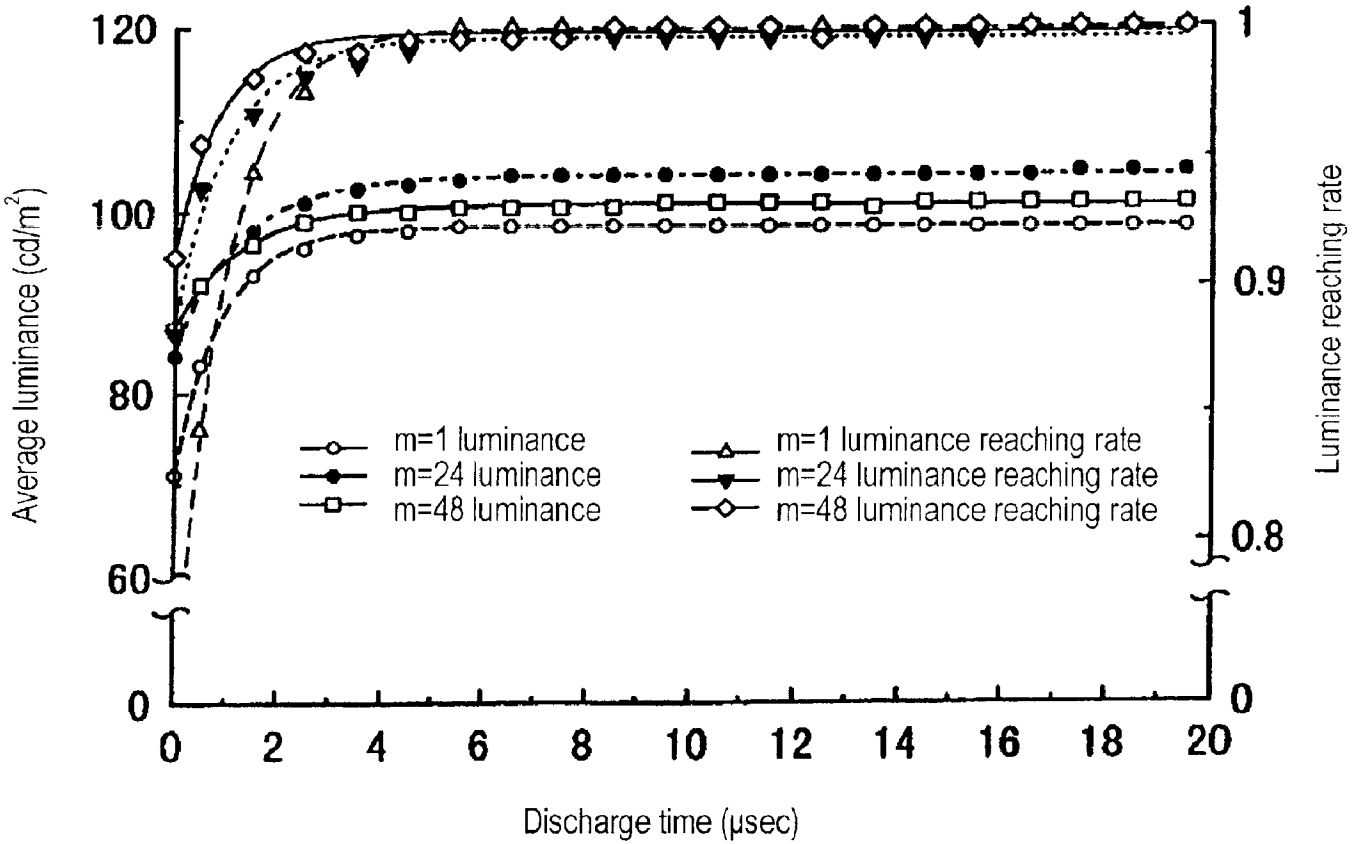
FIG. 7 is a diagram showing the relation of discharge time and luminance of display panel in embodiment 1 of the invention.

FIG. 7 is a graph showing the relation of the discharge time Rt at the time of this driving, and the time average luminance and luminance reaching rate of light emitting elements, supposing m=1, 24, 48. Herein, the luminance reaching rate is the ratio of luminance Lp at a certain discharge time t, and luminance Le when the charge accumulated in the parasitic capacity is regarded to be zero after a sufficient discharge time.

Hence, $$\text{Luminance reaching rate}=Lp/Le.$$

Figure 12:
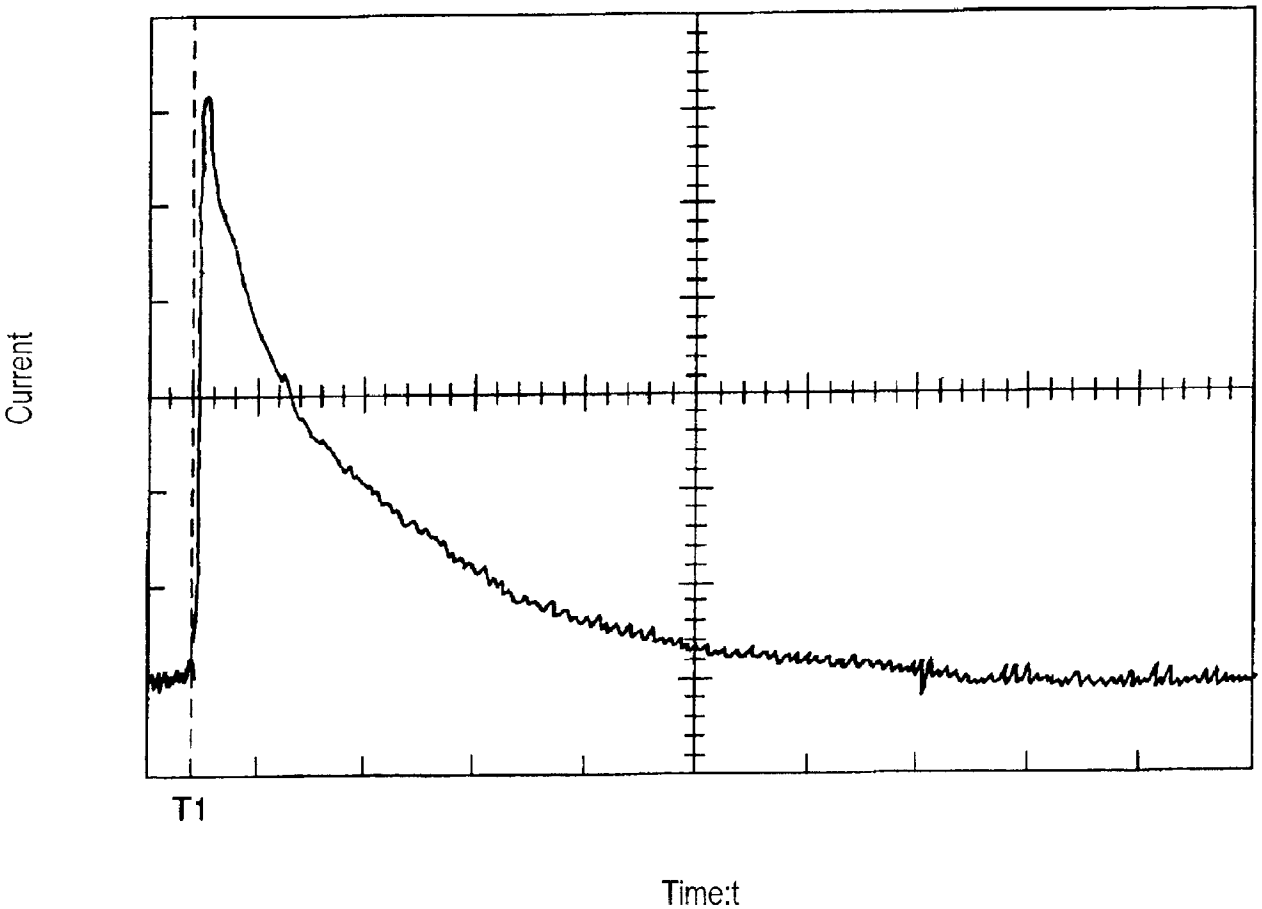
FIG. 12 is a diagram showing discharge characteristic of parasitic capacity.
Figure 13:
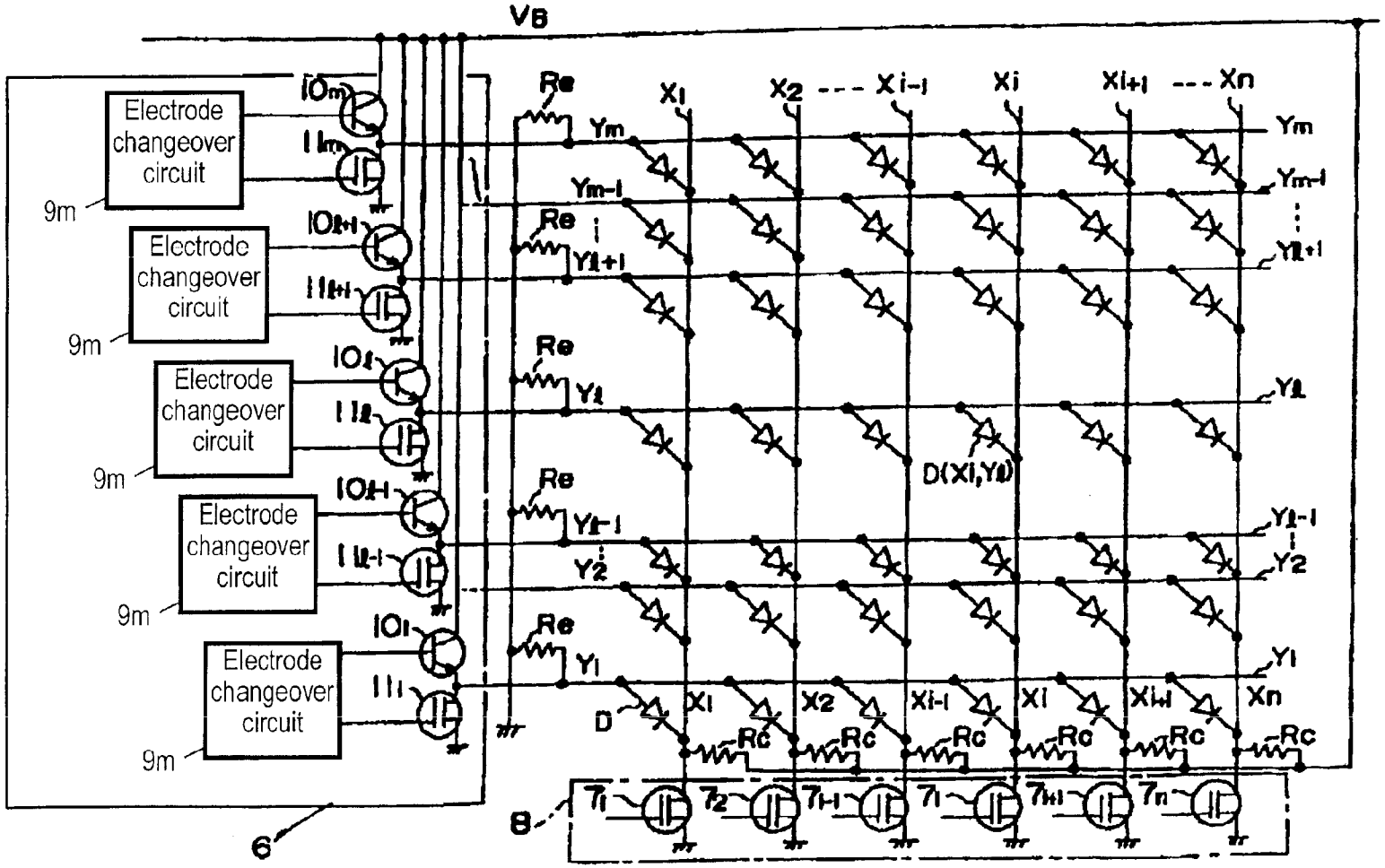
FIG. 13 is an equivalent circuit diagram showing the conventional lighting driving method.

In FIG. 7, in about 6 μsec or less, the luminance changes notably depending on the discharge time. It corresponds to the time of sudden change of discharge current shown in FIG. 12. As a result, there is a large difference in the quantity of electric charge remaining in the parasitic capacity depending on the discharge time, and it is regarded as a cause of change of rise speed of light emission of the light emitting element.

Figure 14B:
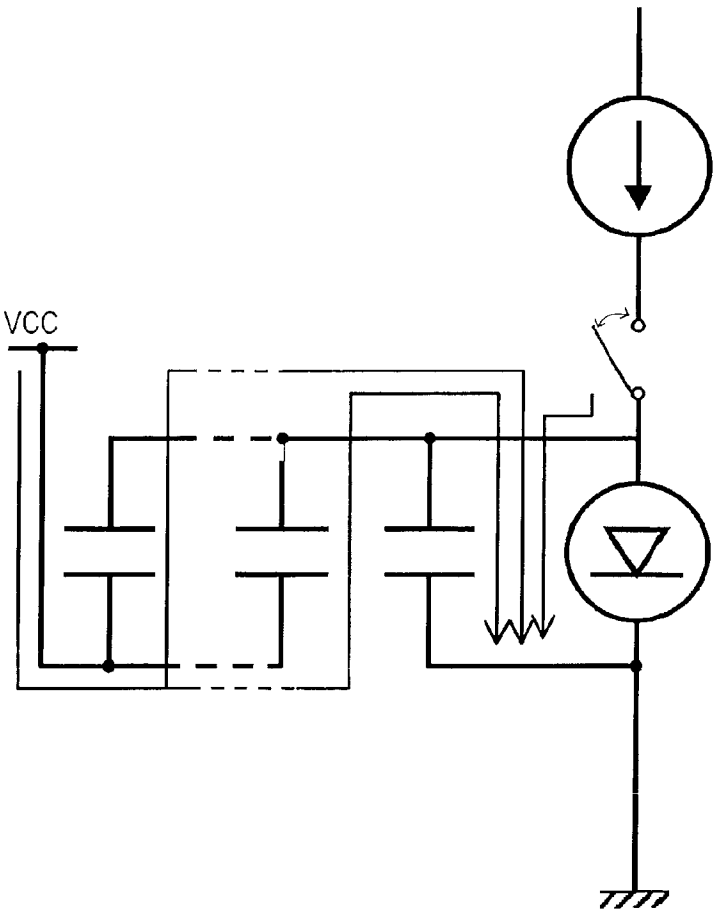
FIG. 14B is a diagram showing a state of an electric charge hardly accumulated in the parasitic capacity of light emitting element.
Figure 14A:
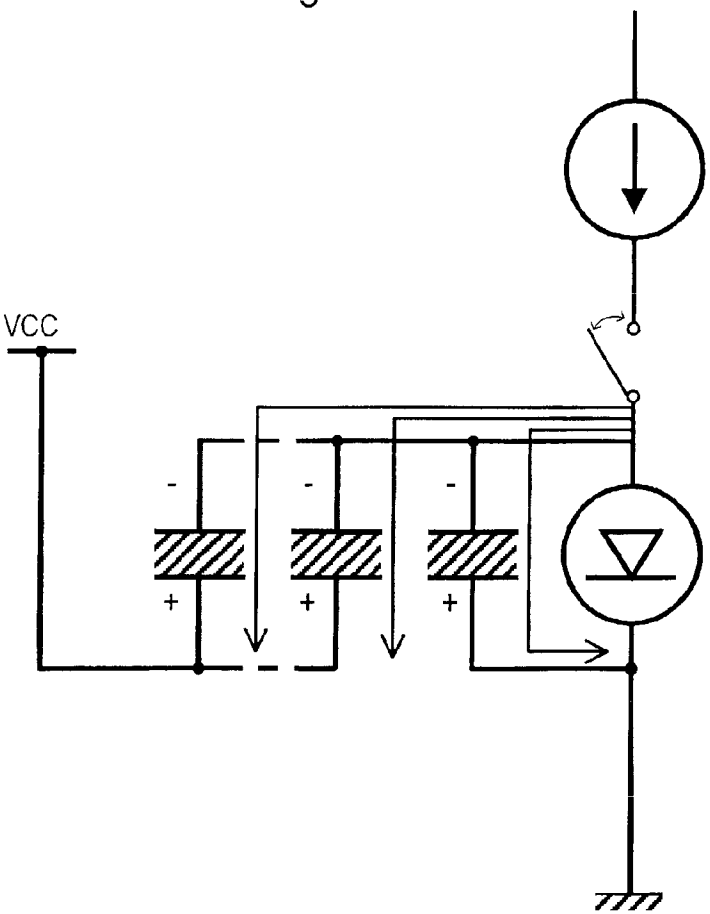
FIG. 14A is a diagram showing an accumulated state of electric charge in the parasitic capacity of light emitting element.
Figure 15:
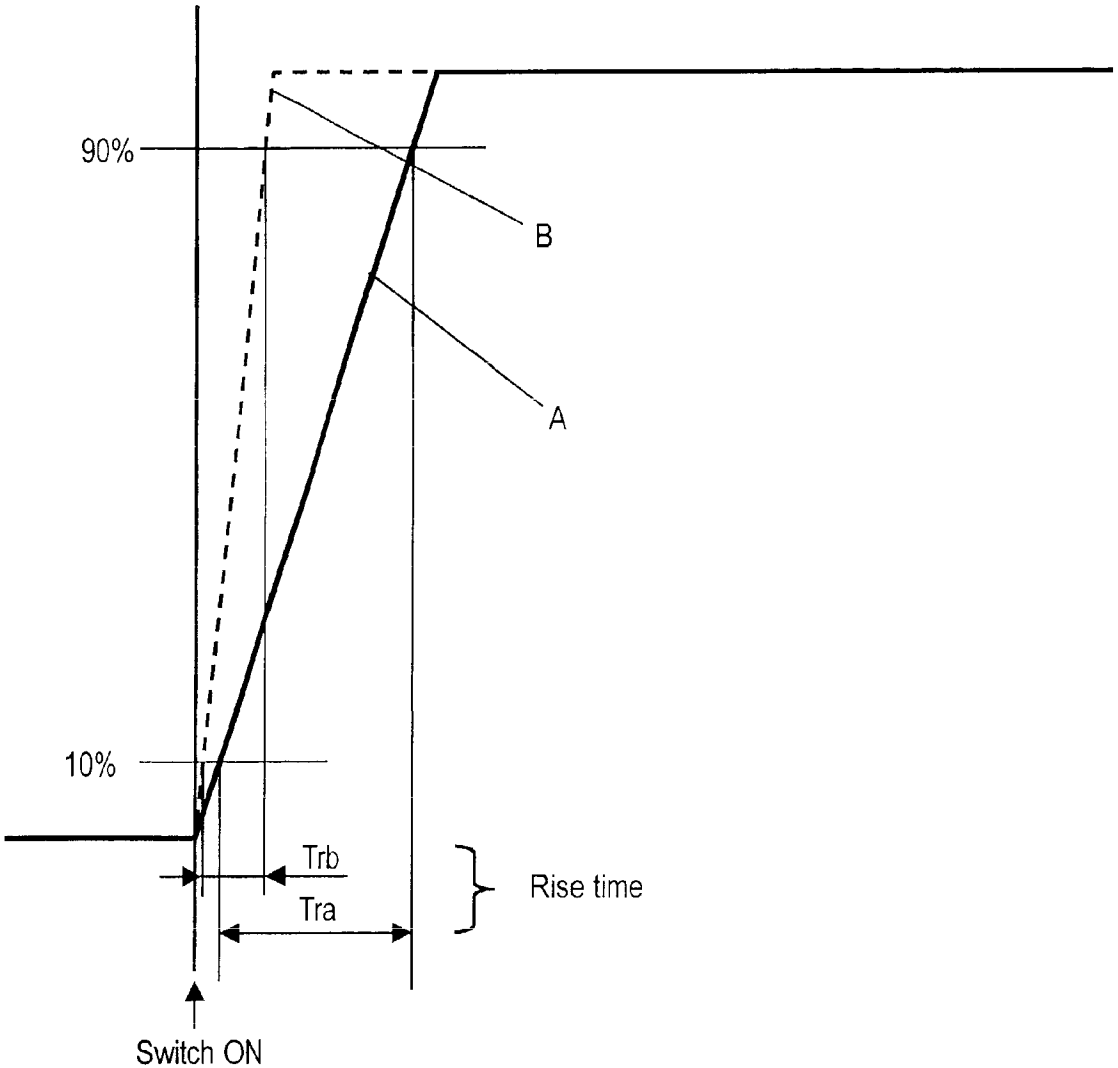
FIG. 15 is a diagram explaining the rise time.

Herein, the rise time Tr is explained by referring to FIG. 14A, FIG. 14B and FIG. 15. FIG. 14A and FIG. 14B show models extracting and showing light emitting elements on a same anode wire on the display panel. FIG. 14A shows a state of accumulation of electric charge in the parasitic capacity of the light emitting element, and FIG. 14B shows a state of hardly accumulating electric charge in the parasitic capacity of the light emitting element. Other light emitting elements than those to emit are expressed by the capacitive components alone.

Passing an electric current into these two models, the relation between the current flowing in the light emitting element and the time is shown in FIG. 15. That is, in the model shown in FIG. 14A, after discharging the charge accumulated in the inverse bias, forward bias is charged. In this case, therefore, it takes time until a constant current flows in the light emitting element (line A in FIG. 15). In the model shown in FIG. 14B, since charge is not accumulated, it is not necessary to discharge. Further, current also flows in from other light emitting elements connected parallel. As a result, the current flows into the light emitting element earlier than in the model shown in FIG. 14A.

Herein, the rise time Tr is defined to be the time required for the forward voltage generated by passing current into the light emitting element to reach from 10% of maximum value to 90% of maximum value. The organic EL element does not emit light unless a voltage exceeding the threshold voltage (usually 3 V to 5 V) is applied. Accordingly, when the rise time is late, the light emitting time is shorter as compared with the driving time. As a result, it appears that the luminance is lowered.

Therefore, as understood from FIG. 15, the rise time Tra of the model shown in FIG. 14A is very long as compared with the rise time Trb of the model shown in FIG. 14B. As a result, the model shown in FIG. 14A is slow in the display speed, which is a defect for a display device.

Incidentally, the rise time differs somewhat depending on the composition of the light emitting element and the luminescent material being used. However, the rise time differs between the case of accumulation of charge in the light emitting element and the case of no accumulation, which holds true if the composition of the light emitting element or luminescent material is different.

Back to FIG. 7, when the discharge time of light emitting element becomes longer, the luminance reaching rate approaches 1 (100%). The required luminance reaching rate varies with the quality required in the image to be displayed, and as a result of experiment, in the display panel of embodiment 1, a practical level was obtained at 0.9 to 0.95 (90% to 95%). In the case luminance control of higher precision is required such as display of multigradation image, the luminance reaching rate is preferred to be closer to 1 (100%). In embodiment 1, supposing the discharge time for satisfying the luminance reaching rate required in the display device to be Tx, and the actual time of discharge to be Rt, the relation of Tx and Rt is defined as follows.

$$Tx \leqq Rt$$

When this relation is satisfied, the accumulated charge can be removed in the time of Rt to the charge level to satisfy the luminance reaching rate required in this display device.

The discharge time is the non-luminescent time. Accordingly, if the non-luminescent time is excessively long in this driving time, the average luminance may be lowered, or the dynamic range may be lowered in the case of pulse width modulation for varying the luminance by changing the pulse width.

Therefore, considering the time of efficient charging, it is preferred to satisfy the formula of $$Rt \leqq B \times Tx \text{ (where } 1<B<10).$$

As a result of experiment by varying the number of luminescent elements in the display panel of the invention, it is found out that the change of the luminance reaching rate is regarded to be almost zero at the value of Rt where the value of B exceeds about 10, and it is concluded that B<10 is preferred.

In FIG. 7, the case of luminance reaching rate of over 0.95 (95%) is described below. Supposing the discharge time in this case to be Tx, it is about 2 μsec, and the actual discharge time is preferred to be 2 μsec or more. Incidentally, since the practicable level in the display panel varies with the image quality required in the display panel, the luminance reaching rate is set at an optimum value for each display panel.

The value of B must be determined in consideration of the driving circuit characteristic, wiring impedance, light emitting element characteristic, discharge characteristic, and fluctuations and others. In the display panel of embodiment 1, it was defined at B=5 to 6 considering from these results. Therefore, the discharge time Rt is $$2\ \mu\text{sec} \leqq Rt \leqq 12\ \mu\text{sec}.$$

Figure 8:
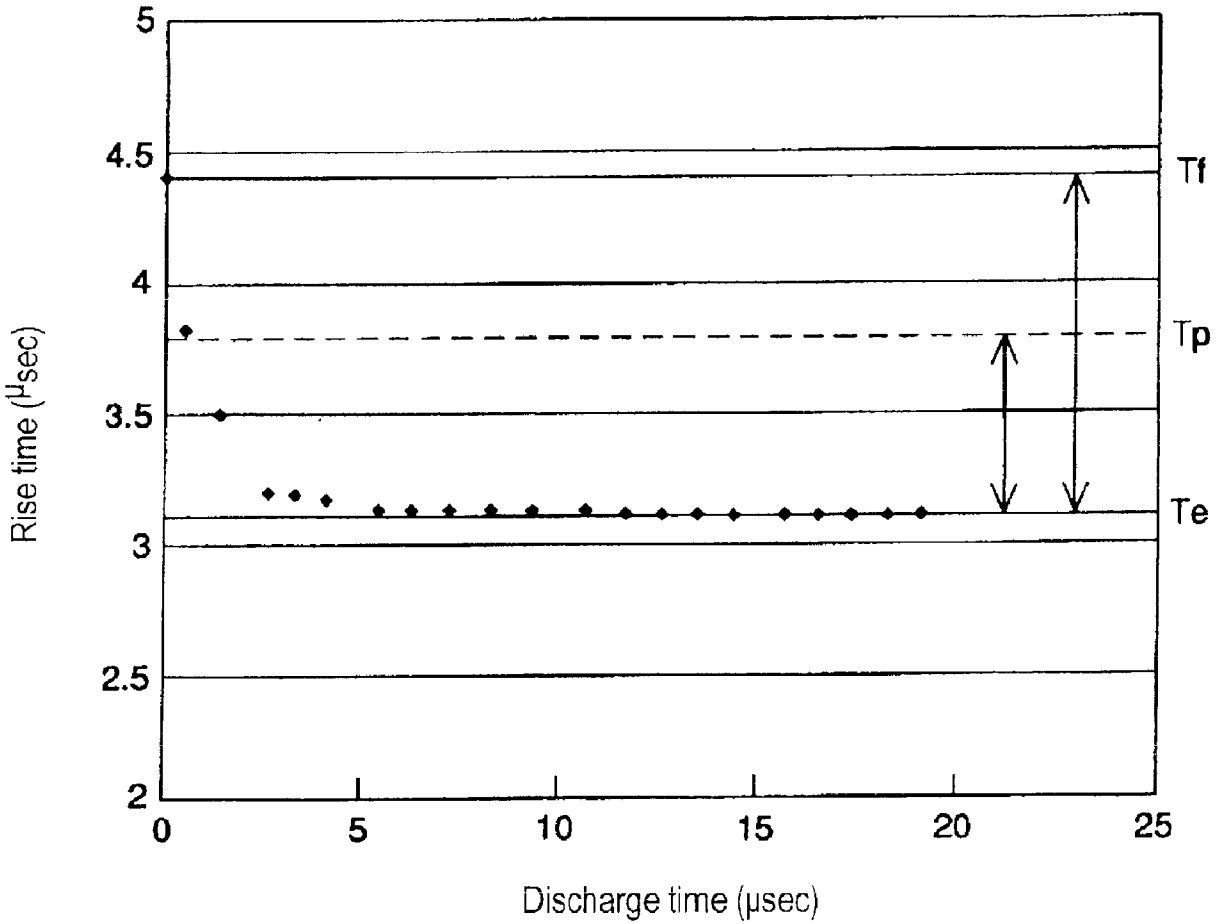
FIG. 8 is a diagram showing the relation of discharge time and voltage rise of display panel in embodiment 1 of the invention.

Further, the embodiment 1 of the invention for determining the optimum discharge time depending on the change of the rise time is explained below. FIG. 8 is a graph showing the relation between the discharge time Rt at m=96 (at this time, Vcc=+10 V) by driving the display panel of embodiment 1 so that the forward bias voltage may be Vf=10 V, and the rise time Tr of the anode wire voltage when the anode wires A1 to A96 are connected to current sources J1 to J96 in FIG. 6. As known from FIG. 8, when the discharge time of the light emitting element is longer than 5 μsec, the rise time is nearly constant, and the rise time is 3.1 μsec (Te). If there is no discharge time, that is, when the charge is hardly taken out from the light emitting element, it is about 4.4 μsec (Tf), and the rise time is considerably long as compared with the case of adding charge after a sufficient discharge time.

In embodiment 1, Tf is the rise time of the light emitting element with no discharge time (the light emitting element accumulating the charge sufficiently), and Te is the rise time having no charge accumulated in the light emitting element after a sufficiently long discharge time (discharge time longer than the scanning driving period of cathode wire), in which $$Tp = K \times (Tf - Te) + Te \text{ (where } 0<K<0.5)$$

further supposing the discharge time corresponding to the rise time Tp expressed above to be Ty, and the discharge time of actual discharge to be Rt, by satisfying the following formula $$Ty \leqq Rt$$

it is possible to remove the charge by discharging sufficiently at the time of Rt. In the formula above, it is known that the optimum discharge time varies by the value of K, but as a result of experiments, it is known that K is preferred to be smaller than 0.5, and hence it is defined at 0<K<0.5.

Considering the time of efficient discharge, it is preferred to satisfy the formula $$Rt \leqq B \times Ty \text{ (where } 1<B<10).$$

Explaining more specifically in FIG. 8, supposing Tf to be about 4.4 μsec, and Te to be about 3.1 μsec, the rise time Tp is $$Tp = K \times (4.4 - 3.1) + 3.1$$

$$Tp = 1.3 \times K + 3.1.$$

Herein, in the display panel of embodiment 1, K is about 0.5, and the rise time Tp is 3.7 μsec. Therefore, from FIG. 8, the discharge time Ty corresponding to the rise time Tp is 2 μsec.

The value of B must be determined in consideration of the driving circuit characteristic, wiring impedance, light emitting element characteristic, discharge characteristic, and other fluctuations. In the display panel of embodiment 1, considering all of them, it was defined at B=5 to 6.

Therefore, an appropriate range of discharge time of embodiment 1 is the following range.

$$2\ \mu\text{sec} \leqq Rt \leqq 12\ \mu\text{sec}$$

Figure 9:
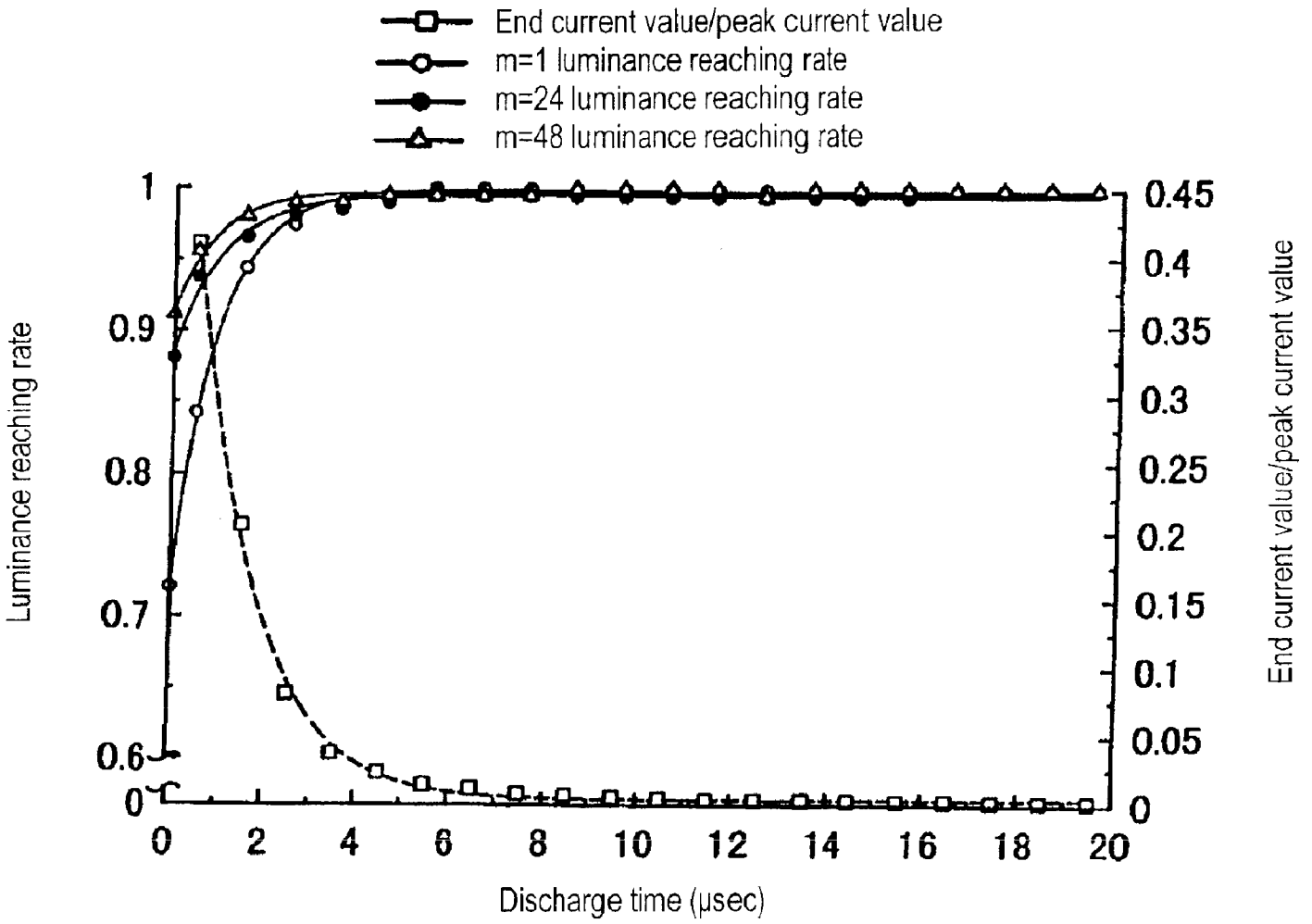
FIG. 9 is a diagram showing the relation of discharge time and discharge current of display panel in embodiment 1 of the invention.

Next, embodiment 1 of the invention for determining the optimum discharge time by the discharge current value is explained below. FIG. 9 is a graph showing the relation of the discharge time Rt in the case of driving of the display panel in embodiment 1 at m=1, 24, 48, the ratio of the discharge current value at the end of discharge operation and the peak value of the discharge current value, and the luminance reaching rate (same as in FIG. 7). As known from FIG. 9, the ratio of the discharge current value at the end, of discharge operation corresponding to the luminance reaching rate of 0.9 to 0.95 (90% to 95%) or more and the peak value of the discharge current value is about 0.3 to 0.1. As the feature of embodiment 1, supposing the maximum value of the discharge current value flowing by discharge to be Ip, the time required for the discharge current to reach the discharge current value Id to satisfy $$Id = D \times Ip \text{ (where } 0<D<0.3)$$

to be Tz, and the actual discharge time to be Rt, by setting the discharge time Rt to satisfy the relation of $Tz \leqq Rt$ it is possible to remove the electric charge by discharging securely.

Moreover, considering the time for efficient discharge, it is preferred to satisfy the formula $Rt \leqq B \times Tz$ (where $1<B<10$).

Explaining more specifically in FIG. 9, the ratio of the discharge current value upon completion of discharge operation corresponding to the luminance reaching rate of 0.95 (95%) and the peak value of discharge current value is about 0.1. The value of Tz is about 2 μsec. The value of B must be determined in consideration of the driving circuit characteristic, wiring impedance, light emitting element characteristic, discharge characteristic, and other fluctuations. In the display panel of embodiment 1, considering these factors, it is defined at B=6. Therefore, the actual discharge time is preferred to be $2\ \mu sec \leqq Rt \leqq 12\ \mu sec.$ Further, since the discharge current can be measured easily, it is easy to execute, which is also an outstanding effect.

Figure 10:
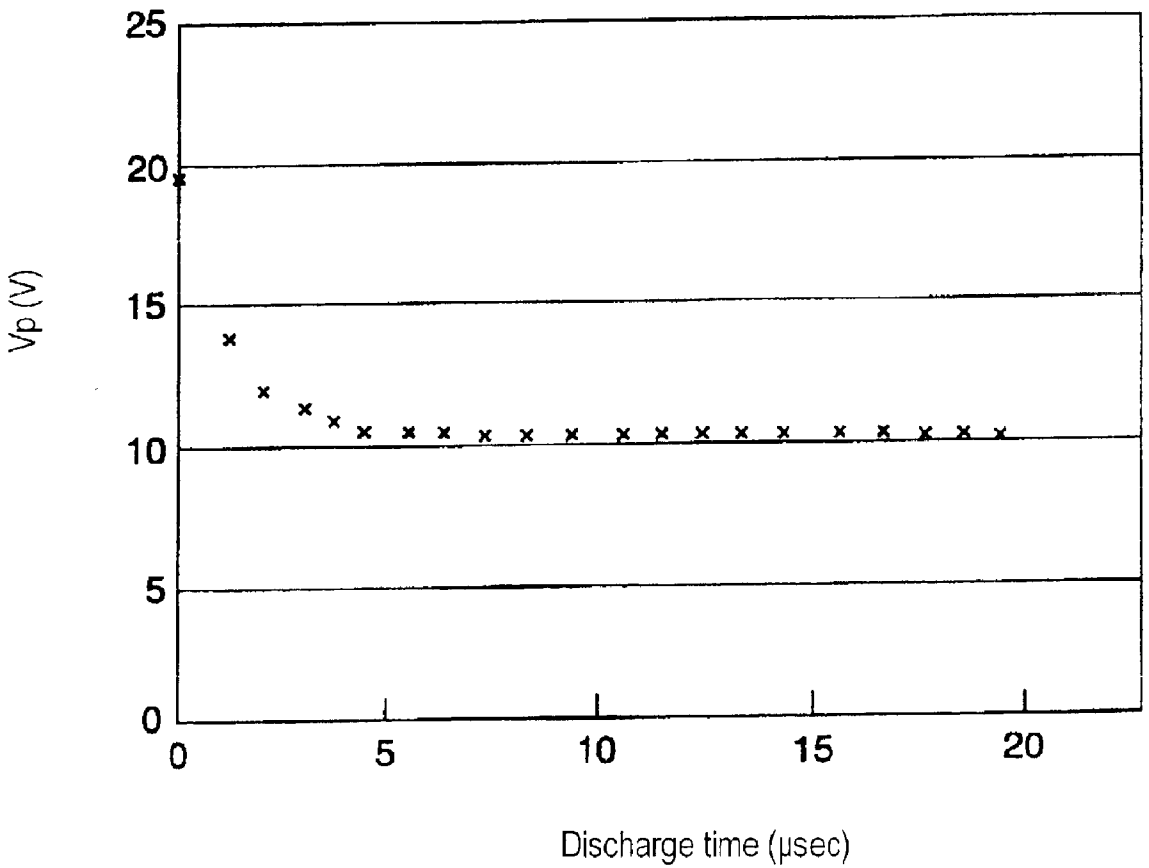
FIG. 10 is a diagram showing the relation of discharge time and peak voltage occurring in the cathode of display panel in embodiment 1 of the invention.
Figure 11:
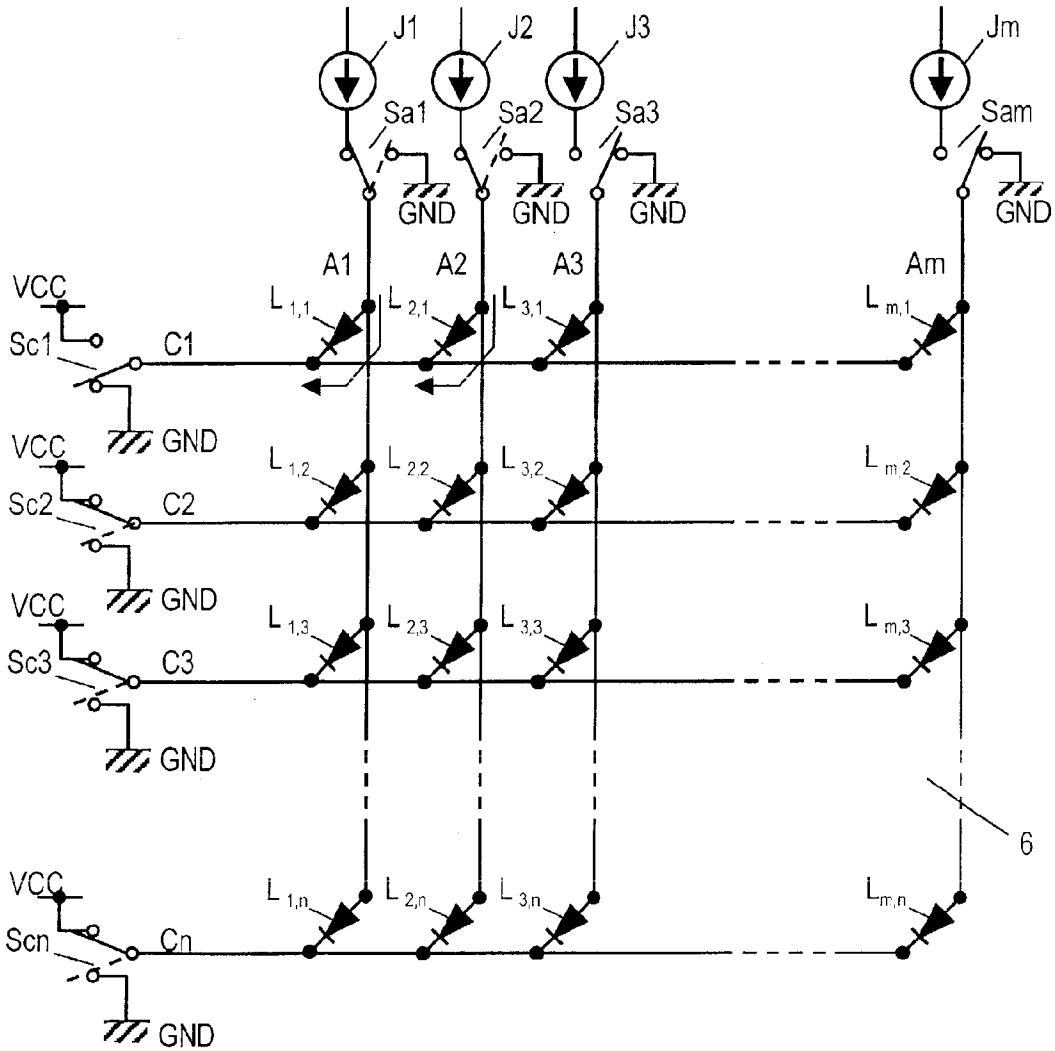
FIG. 11 is a diagram showing the conventional light emitting driving driving method and discharge method of parasitic capacity.

FIG. 10 is a graph showing the relation between the discharge time Rt, and the peak value of the voltage generated at both ends of the light emitting element connected to the cathode wire C3 in the process shown in FIG. 4, FIG. 5, and FIG. 6. As clear from the characteristic shown in FIG. 10, in the display panel of embodiment 1, by controlling the discharge time at Rt=2 to 12 μsec, generation of undesired voltage can be suppressed. Therefore, the semiconductor switching element used in the invention is not required to have a high withstand voltage as in the prior art.

Incidentally, the display controller and setting unit may be included in the controller of the portable terminal using the display device of the invention. Setting by the setting unit may be preset before being incorporated into the portable terminal using the display device of the invention, or may be set after being incorporated into the portable terminal using the display device of the invention, either.

Thus, according to the invention, by properly setting the discharge time Rt, the effect of parasitic capacity of the organic EL elements can be efficiently eliminated, and it brings about a beneficial effect of realizing the display device higher in driving speed, superior in reliability, lower in price, and smaller in size. As a result, the driving efficiency is improved, and it improves the conventional defect of an apparent lowering of display luminance.

Embodiment 2

Figure 17:
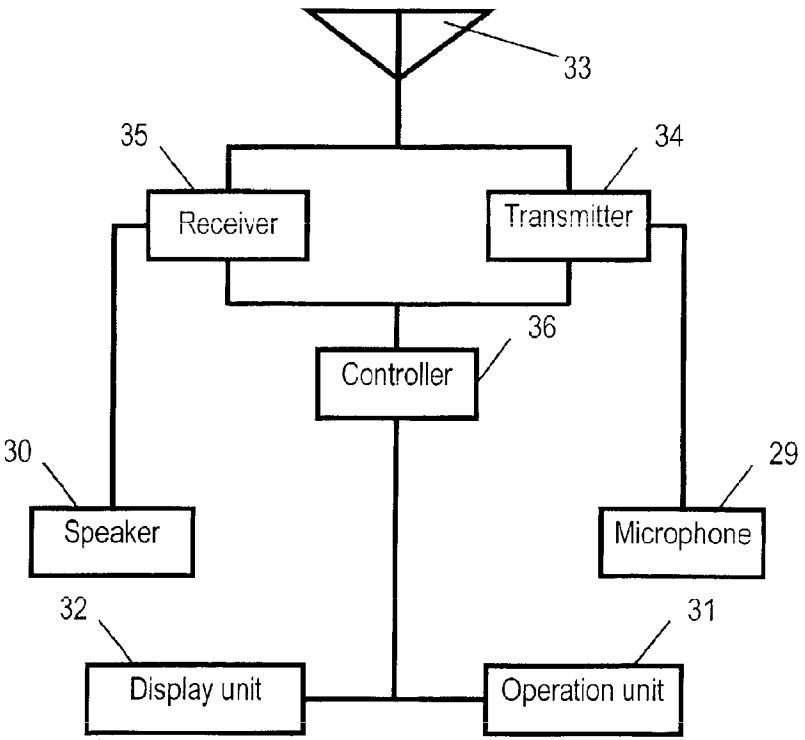
FIG. 17 is a block diagram showing a portable terminal in embodiment 2 of the invention.
Figure 16:
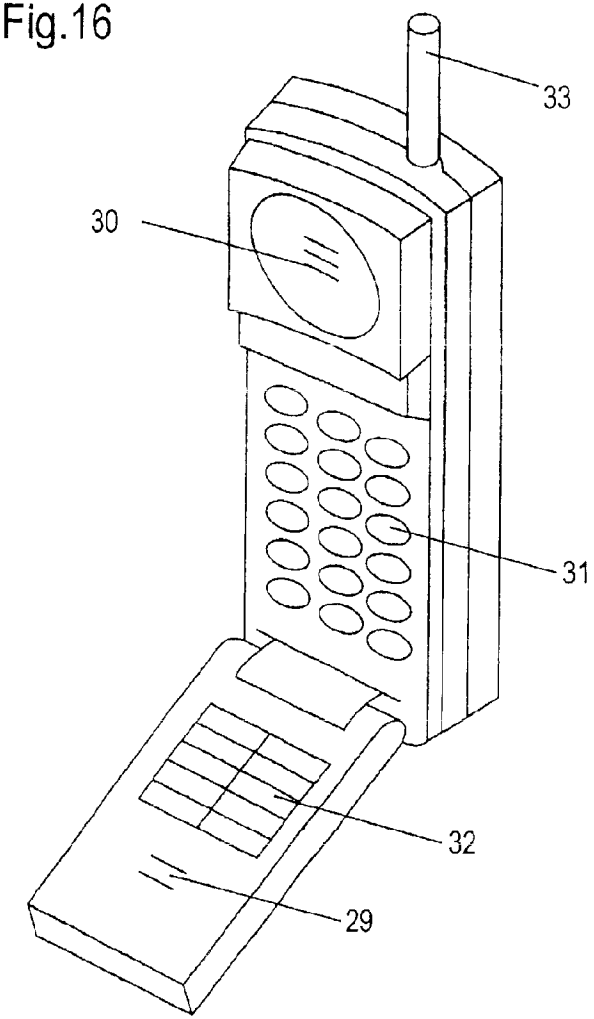
FIG. 16 is a perspective view showing a portable terminal in embodiment 2 of the invention.

FIG. 16 and FIG. 17 are perspective view and block diagram showing a portable terminal having the display device shown in embodiment 1 of the invention.

The portable terminal in embodiment 2 shown in FIG. 16 and FIG. 17 comprises:

a) a microphone 29 for converting sound into an audio signal, b) a speaker 30 for converting the audio signal into sound, c) an operation unit 31 composed of dial button and others, d) a display unit 32 for displaying incoming and others as shown in embodiment 1 of the invention, e) an antenna 33, f) a transmitter 34 for converting the audio signal from the microphone 29 into a transmission signal, g) a receiver 35 for converting the reception signal received in the antenna 33 into an audio signal, h) a controller 36 for controlling the transmitter 34, receiver 34, operation unit 31, and display unit 32.

In the portable terminal having such configuration, the transmission signal created in the transmitter 34 is released to outside through the antenna 33, and the audio signal created in the receiver 35 is converted into sound in the speaker 30.

An example of its operation is described below.

In the event of an incoming, in the first place, an incoming signal is transmitted from the receiver 35 to the controller 36. According to the incoming signal, the controller 36 displays specified characters and others in the display unit 32. Further, when the button for receiving the incoming signal is pushed in the operation unit 31, the signal is transmitted to the controller 36, and the controller 36 sets each part in the incoming mode. That is, the signal received in the antenna 33 is converted into an audio signal in the receiver 35, and the audio signal is issued as sound from the speaker 30. At the same time, the sound entered from the microphone 29 is converted into an audio signal, and is transmitted to outside from the transmitter 34 through the antenna 33.

A case of originating is described below.

First, in the event of an originating, a signal for originating from the operation unit 31 is entered into the controller 36. In succession, a signal corresponding to the telephone number is sent from the operation unit 31 to the controller 36, and the controller 36 transmits a signal corresponding to the telephone number from the antenna 33 through the transmitter 34. By this transmission signal, when the communication with the partner is established, its signal is transmitted to the controller 36 from the antenna 33 through the receiver 35. Receiving the signal of establishment of communication, the controller 36 sets each part in the originating mode. That is, the signal received in the antenna 33 is converted into the audio signal in the receiver 35, and the audio signal is issued as sound from the speaker 30. The sound entered from the microphone 29 is converted into an audio signal, and the audio signal is transmitted to outside from the transmitter 34 through the antenna 33.

In embodiment 2, meanwhile, an example of transmitting and receiving sound is shown, but not limited to the sound, the same effect is obtained in the device for at least transmitting or receiving other data than sound such as character data.

The portable terminal of embodiment 2 comprises the display unit shown in embodiment 1, and hence the driving efficiency of the display unit is improved, and the conventional problem of apparent lowering of display luminance is improved. Further, the portable terminal of embodiment 2 realizes a portable terminal comprising the display device higher in driving speed, superior in reliability, lower in price, and smaller in size, which is an outstanding effect.

What is claimed is:

1. A display device comprising:

a plurality of cathode wires, a plurality of anode wires arranged in a matrix shape together with said plurality of cathode wires, electroluminescence (EL) elements disposed between said plurality of cathode wires and anode wires, and in which an electrical charge is stored, a current source coupled to said anode wires, a voltage source coupled to said cathode wires, an anode control circuit connected between said anode wires and said current source, for discharging said stored charge from said EL elements, and for controlling respective current flow into said anode wires, a cathode control circuit connected between said cathode wires and said voltage source, for discharging said stored charge from said EL elements, and for controlling respective voltages at said cathode wires, a display controller for controlling said anode control circuit and said cathode control circuit, said display controller including a setting unit for setting a discharge time for discharging said stored charge of said EL elements before light emission of said EL elements to a time Rt, wherein a discharge time Tx for discharging said stored charge before light emission of said EL elements is determined so as to obtain a luminance Lp of said EL elements determined by:

$$Lp \geqq 0.9 \times Le,$$

where Le is a luminance of light emitted by said EL elements storing substantially no electrical charge, and said discharge time Rt satisfies the relation of:

$$Tx \leqq Rt.$$

2. The display device of claim 1, wherein the discharge time Rt is set to satisfy the relation of $$Rt \leqq B \times Tx \text{ (where } 1<B<10).$$

3. The display device of claim 1, wherein Tf Is the rise time of an El element accumulating the charge sufficiently, and Te is the rise time of an El element having no charge accumulated in the El element or almost no charge accumulated, being in the relation of $$Tp = K \times (Tf - Te) + Te \text{ (where } 0<K<0.5)$$

and the rise time Tp to satisfy this relation is determined, and further supposing the discharge time corresponding to said rise time Tp to be Ty, and the discharge time Rt is set to satisfy the relation of $$Ty \leqq Rt.$$

4. The display device of claim 3, wherein the discharge time Rt is set so satisfy the relation of $$Rt \leqq B \times Ty \text{ (where } 1<B<10).$$

5. The display device of claim 1, wherein supposing the maximum value of the discharge current value flowing by discharge of said accumulated charge to be Ip, the time required for the discharge current to reach the discharge current value Id to satisfy $$Id = D \times Ip \text{ (where } 0<D<0.3)$$

to be Tz, and the discharge time Rt is set to satisfy the relation of $$Tz \leqq Rt.$$

6. The display device of claim 5, wherein the discharge time Rt is set to satisfy the relation of $$Rt \leqq B \times Tz \text{ (where } 1<B<10).$$

7. A method of driving a display device, said method comprising the steps of:

providing a display device having a plurality of cathode wires, a plurality of anode wires arranged in a matrix shape together with said plurality of cathode wires, and electroluminescence (EL) elements disposed between said plurality of wires and anode wires, wherein an electrical charge is stored in said EL elements, discharging said stored charge from said EL elements before light emission of the EL elements, controlling respective current flow into said anode wires, controlling respective voltages at said cathode wires, and setting a discharge time for which said stored charge is discharged from said EL elements before light emission of said EL elements to a time Rt, wherein a discharge time Tx for discharging said stored charge before light emission of said EL elements is determined so as to obtain a luminance Lp of said EL elements determined by:

$$Lp \geqq 0.9 \times Le,$$

where Le is a luminance of light emitted by said EL elements storing substantially no electrical charge, and said discharge time Rt satisfies the relation of:

$$Tx \leqq Rt.$$

8. The method of claim 7, wherein the discharge time Rt is set to satisfy the relation of $$Rt \leqq B \times Tx \text{ (where } 1<B<10).$$

9. The method of claim 7, wherein Tf is the rise time of said EL elements accumulating the charge sufficiently, and Te is the rise time of said EL elements having no charge accumulated in elements or almost no charge accumulated, and the rise time Tp is determined by the relation $$Tp = K \times (Tf - Te) + Te \text{ (where } 0<K<0.5)$$

and the discharge time corresponding to said rise time Tp is Ty, and the discharge time Rt is set to satisfy the relation of $$Ty \leqq Rt.$$

10. The method of claim 9, wherein the discharge time Rt is set to satisfy the relation of $$Rt \leqq B \times Ty \text{ (where } 1<B<10).$$

11. The method of claim 7, wherein with the maximum value of the discharge current value flowing by discharge of said accumulated charge being Ip, and the time required for the discharge current to reach the discharge current value Id to satisfy $$Id = D \times Ip \text{ (where } 0<D<0.3)$$

being Tz, and the discharge time Rt is set to satisfy the relation of $$Tz \leqq Rt.$$

12. The method of claim 11, wherein the discharge time Rt is set to satisfy the relation of $$Rt \leqq B \times Tz \text{ (where } 1<B<10).$$

13. A display device comprising:

a plurality of cathode wires, a plurality of anode wires arranged in a matrix shape together with said plurality of cathode wires, electroluminescence (EL) elements disposed between said plurality of cathode wires and anode wires, and in which an electrical charge is stored, a current source coupled to said anode wires, a voltage source coupled to said cathode wires, an anode control circuit connected between said anode wires and said current source, for discharging said stored charge from said EL elements, and for controlling respective current flow into said anode wires, a cathode control circuit connected between said cathode wires and said voltage source, for discharging said stored charge from said EL elements, and for controlling respective voltages at said cathode wires, a display controller for controlling said anode control circuit and said cathode control circuit, said display controller including a setting unit for setting a discharge time for discharging said stored charge of said EL elements before light emission of said EL elements to a time Rt, wherein a discharge time Tx for discharging said stored charge before light emission of said EL elements Is determined so as to obtain a luminance Lp of said EL elements determined by:

$$Lp \geqq 0.9 \times Le,$$

where Le is a luminance of light emitted by said EL elements storing no electrical charge or almost no electrical charge, and said discharge time Rt satisfies the relation of:

$$Tx \leqq Rt.$$

14. The display device of claim 13, wherein said plurality of anode wires are formed in stripes, and said plural cathode wires are also formed in stripes.

15. The display device of claim 13, wherein the discharge time (Rt) is set to satisfy the relation of $$Rt \leqq B \times Tx \text{ (where } 1<B<10).$$

16. The display device of claim 13, wherein Tf is the rise time of an EL element accumulating the charge sufficiently, and Te is the rise time of an EL element having no charge accumulated in the EL element or almost no charge accumulated, being in the relation of $$Tp = K \times (Tf - Te) + Te \text{ (where } 0<K<0.5)$$

and the rise time Tp to satisfy this relation is determined, and further supposing the discharge time corresponding to said rise time Tp to be Ty, and the discharge time is set to satisfy the relation of $$Ty \leqq Rt.$$

17. The display device of claim 16, wherein the discharge time Rt is set so satisfy the relation of $$Rt \leqq B \times Ty \text{ (where } 1<B<10).$$

18. The display device of claim 13, wherein supposing the maximum value of the discharge current value flowing by discharge of said accumulated charge to be Ip, the time required for the discharge current to reach the discharge current value Id to satisfy $$Id = D \times Ip \text{ (where } 0<D<0.3)$$

to be Tz, and the discharge time Rt is set to satisfy the relation of $$Tz \leqq Rt.$$

19. The display device of claim 18, wherein the discharge time Rt is set to satisfy the relation of $$Rt \leqq B \times Tz \text{ (where } 1<B<10).$$

20. A method of driving a display device, said method comprising the steps of:

providing a display device having a plurality of cathode wires, a plurality of anode wires arranged in a matrix shape together with said plurality of cathode wires, and electroluminescence (EL) elements disposed between said plurality of cathode wires and anode wires, wherein an electrical charge is stored in said EL elements, discharging said stored charge from said EL elements before light emission of the EL elements, controlling respective current flow into said anode wires, controlling respective voltages at said cathode wires, and setting a discharge time for which said stored charge is discharged from said EL elements before light emission of said EL elements to a time Rt, wherein a discharge time Tx for discharging said stored charge before light emission of said EL elements is determined so as to obtain a luminance Lp of said EL elements determined by:

$$Lp \geqq 0.9 \times Le,$$

where Le is a luminance of light emitted by said EL elements storing no electrical charge of almost no electrical charge, and said discharge time Rt satisfies the relation of:

$$Tx \leqq Rt.$$

21. The method of claim 20, wherein the discharge time Rt is set to satisfy the relation of $$Rt \leqq B \times Tx \text{ (where } 1<B<10).$$

22. The method of claim 20, wherein Tf is the rise time of said EL elements accumulating the charge sufficiently, and Te is the rise time of said EL elements having no charge accumulated in elements or almost no charge accumulated, and the rise time Tp is determined by the relation of $$Tp = K \times (Tf - Te) + Te \text{ (where } 0<K<0.5)$$

and the discharge time corresponding to said rise time Tp is Ty, and the discharge time Rt is set to satisfy the relation of $$Ty \leqq Rt.$$

23. The method of claim 22, wherein the discharge time Rt is set to satisfy the relation of $$Rt \leqq B \times Ty \text{ (where } 1<B<10).$$

24. The method of claim 20, wherein with the maximum value of the discharge current value flowing by discharge of said accumulated charge being Ip, and the time required for the discharge current to reach the discharge current value to satisfy $$Id = D \times Ip \text{ (where } 0<D<0.3)$$

being Tz, and the discharge time Rt is set to satisfy the relation of $$Tz \leqq Rt.$$

25. The method of claim 24, wherein the discharge time Rt is set so satisfy the relation of $Rt \leqq B \times Tz$ (where $1<B<10$).

* * * * *